United States Patent [19]

Jones

[11] 4,186,009

[45] Jan. 29, 1980

[54] COVERING POWER PHOTOTHERMOGRAPHIC MATERIAL AND PROCESS

[75] Inventor: Cynthia G. Jones, Bergen, N.Y.

[73] Assignee: Eastman Kodak Company, Rochester, N.Y.

[21] Appl. No.: 912,168

[22] Filed: May 30, 1978

[51] Int. Cl.[2] ..... G03C 5/24; G03C 1/02

[52] U.S. Cl. ..... 430/353; 430/598; 430/596; 430/617

[58] Field of Search ..... 96/114.1, 48 HD, 95, 96/64, 59

[56] References Cited

U.S. PATENT DOCUMENTS

| | | | |
|---|---|---|---|
| 1,962,348 | 6/1934 | Jelley | 96/59 |
| 1,970,869 | 8/1934 | Schloemann | 96/59 |
| 2,150,704 | 3/1939 | Ville | 96/59 |
| 3,312,550 | 4/1967 | Stewart et al. | 96/95 |
| 3,736,140 | 5/1973 | Collier | 96/64 |
| 3,785,830 | 1/1974 | Sullivan et al. | 96/114.1 |
| 3,893,860 | 7/1975 | Sutton et al. | 96/48 HD |
| 4,030,925 | 6/1977 | Leone et al. | 96/95 |
| 4,082,555 | 4/1978 | Merkel | 96/114.1 |
| 4,123,274 | 10/1978 | Knight | 96/114.1 |
| 4,128,557 | 12/1978 | Knight | 96/114.1 |

FOREIGN PATENT DOCUMENTS

| | | | |
|---|---|---|---|
| 808585 | 3/1969 | Canada | 96/95 |
| 1163187 | 9/1969 | United Kingdom | 96/114.1 |
| 1403018 | 8/1975 | United Kingdom | 96/64 |

OTHER PUBLICATIONS

*Research Disclosure*, Item No. 15869, Jun. 1977.

Research Disclosure, Item No. 15168, pp. 88–90, Nov. 1976.

Research Disclosure, Item No. 11322, p. 33, Sep. 1973.

Research Disclosure, Item No. 12535, pp. 40–41, Sep. 1974.

K. Murofushi, J. Soc. Sci. Phot., Japan, vol. 30(4), pp. 193–198 (1967).

"The Theory of the Phot. Process", 3rd Edition by Mees, pp. 74–75; 419–420, 1966.

Product Licensing Index, vol. 92, Dec. 1971, Item 9232.

Research Disclosure, pp. 16–21, Jan. 1973.

*Primary Examiner*—Won H. Louie, Jr.

*Attorney, Agent, or Firm*—Richard E. Knapp

[57] ABSTRACT

A covering power, heat developable photographic material comprising, in binder, and in reactive association (a) negative-working photosensitive silver halide, (b) an image-forming combination comprising (i) an organic silver salt oxidizing agent containing a heterocyclic thione ligand or 1,2,4-mercaptotriazole ligand with (ii) an organic reducing agent and (c) a nucleating concentration of a hydrazino thiourea nucleating agent, enables a positive image to be developed and, in most cases, stabilized even though the photothermographic material contains no separate post-processing image stabilizer. The heat developable silver halide photographic material also enables development efficiency that is better than in those photothermographic silver halide materials not based on covering power imaging. A positive image can be developed in the heat developable photographic material after imagewise exposure by merely heating the material to moderately elevated temperatures. Other addenda employed in heat developable materials can be useful in the described heat developable photographic materials.

26 Claims, No Drawings

COVERING POWER PHOTOTHERMOGRAPHIC MATERIAL AND PROCESS

BACKGROUND OF THE INVENTION

1. Field of the Invention

This invention relates to certain covering power, heat developable photographic materials and processes for developing a positive image with the described materials. In one of its aspects it relates to a covering power, heat developable photographic element comprising the described combination of components capable of providing a positive developed image. In another aspect it relates to a covering power, heat developable photographic composition comprising the described combination. A further aspect of the invention relates to a process of developing a positive image in a covering power, heat developable photographic material containing the described imaging combination.

2. Description of the State of the Art

It is known to obtain an image in an imaging material, especially a photographic imaging material, by what is known as dry processing with heat. These materials are sometimes described as heat developable photographic materials or photothermographic materials. Such heat developable photographic materials are imagewise exposed to provide a latent image. They are then heated to provide a developed image in the absence of processing solutions or baths. An example of a heat developable photographic material which comprises a photosensitive silver halide with an image-forming combination comprising (1) a silver salt of a certain 1,2,4-mercaptotriazole derivative with a silver halide developing agent is described, for example, in *Research Disclosure,* June 1977, Volume 158, Item No. 15869, of P. D. Knight et al, published by Industrial Opportunities Limited, Homewell, Havant Hampshire, P09 1EF, UK. Another example of a heat developable photographic material is described in U.S. Pat. No. 3,785,830 of Sullivan et al, issued Jan. 15, 1974. This heat developable photographic material contains photosensitive silver halide with an image-forming combination of an organic silver salt oxidizing agent containing a certain heterocyclic thione ligand and a reducing agent. These heat developable photographic materials are useful for providing a developed image in the absence of processing solutions or baths; but, the materials have not been suggested for providing a developed image with covering power, reversal imaging.

Photographic materials are known which can provide development of an image in such materials by what is known as covering power imaging. A fundamental difference exists between conventional silver development processes and what are described as covering power imaging processes. In most conventional photographic silver materials, changes in optical density with exposure arise primarily from differences in the amount of silver reduced at the latent image sites. In silver covering power imaging the amount of silver reduced does not vary greatly with exposure. In such covering power imaging, density variations at image areas are due, for the most part, to differences in silver covering power at various exposure levels. Silver covering power imaging, as used herein, is intended to mean imaging in a photographic silver material in which variations in optical density of the developed image derive primarily from variations in silver covering power as a function of exposure. Covering power, as used herein, is intended to mean the measure of the silver opacity in the developed image and is derived arithmetically by dividing (a) the optical density by (b) the grams of developed silver per unit area, such as per square decimeter, in the layer of the material containing the developed image. Covering power and covering power imaging are known in conventional photographic materials which provide development with processing solutions or baths. This is described, for example, in the article by K. Murofushi, *J. Soc. Sci. Phot.,* Japan, Volume 30 (4), 193–198 (1967), Canadian Pat. No. 808,585, and "The Theory of the Photographic Process", 3rd Edition, by Mees, 1966, pages 74–75 and 419–420. Covering power imaging has also been described in heat developable photographic silver elements, such as in *Research Disclosure,* Volume 151, November 1976, Item No. 15168, of P. B. Merkel. None of the photographic materials described have used covering power in heat developable photographic materials with certain nucleating agents to enable reversal imaging.

Photographic silver halide materials are known for producing reversal or direct-positive images with processing solutions or baths. None of these photographic materials have been used for producing covering power, reversal imaging with a heat developable photographic element.

It has been desirable to provide a heat developable photographic material and process which enable development of a reversal or positive image with a reduced concentration of silver and in the absence of processing solutions or baths. The heat developable photographic materials described have not enabled these advantages and also have not enabled the desired degree of reduction of silver in a heat developable material with the production of a positive or reversal image.

SUMMARY OF THE INVENTION

It has been found according to the invention that the described advantages can be provided in a covering power, heat developable photographic material comprising, in binder and in reactive association (a) a negative-working photosensitive silver halide in reactive association with (b) an image-forming combination consisting essentially of (i) an organic silver salt oxidizing agent containing a heterocyclic thione ligand or 1,2,4-mercaptotriazole ligand with (ii) an organic reducing agent, and (c) a nucleating concentration of a hydrazino thiourea nucleating agent wherein the photographic material is capable of providing a positive image when exposed and heat developed. Development, and in most cases stabilization, of an image in the described heat developable material can be produced, after imagewise exposure, by merely heating the material at moderately elevated temperatures until the desired image is developed, such as for several seconds. The material can be heated to a temperature within the range of about 120° C. to about 180° C. The image developed is a positive image. No processing solutions or baths are required to provide a developed image having the described properties.

DETAILED DESCRIPTION OF THE INVENTION

An important embodiment of the invention is a covering power, heat developable photographic element comprising a support having thereon, in binder, the described components (a), (b), and (c) and wherein the element is capable of providing a positive image when exposed and heat developed.

The term "covering power" as employed herein is intended to refer to a photographic silver halide material in which the imaging mechanism is one in which the mass of silver developed is essentially independent of exposure. It is also intended to include those materials in which covering power variations responsible for imaging primarily arise from silver particle size differences in the exposed and unexposed areas. While the exact mechanism involved in the development of an image in the materials of the invention is not completely understood, it is believed that the nucleating concentration of the hydrazino thiourea nucleating agent provides fogging of the organic silver salt, as described, in the non-exposed areas of the photographic material upon heating the material to processing temperature. The developed image areas also described as the maximum density areas of the photographic element are the unexposed areas containing the described nucleating concentration of the hydrazino thiourea. The particles developed in the exposed areas of the photographic material with covering power imaging typically have particle diameters ten times as large and contain about 1,000 times as much silver as the silver particles in the other areas of the developed photographic material. The resulting image areas have roughly a ten-fold difference in transmission density between maximum density and minimum density. In view of the fact that development is essentially complete throughout the element, that is development efficiency is considered to be high, in most cases no need exists for fixation or stabilization of undeveloped silver ions. The excellent photolytic stability of the photographic materials upon development is a consequence of the fact that substantially no photosensitive or other silver salts or complexes remain in the element to print-up after processing. The high development efficiency in the element also provides a degree of assurance that undesired fog formation from over processing will not occur.

It is observed according to the invention that the background areas of the exposed element after exposure and during heat processing completely fog. It is believed that the organic silver salt oxidizing agent readily undergoes nucleation due to the presence of the hydrazino thiourea nucleating agent and that this accelerates the formation of fog in the background areas. Electron microscopic analysis of a processed photographic element according to the invention shows filamentary silver contributed by the silver halide in the image areas and silver particles in the background areas of the element. The difference in covering power between these two types of reduced silver is believed to provide the positive developed image.

The covering power, heat developable photographic materials of the invention contain a negative-working photosensitive silver halide. The term "negative-working" as used herein is intended to refer to photosensitive silver halide that is prepared to provide a negative developed image with conventional imagewise exposure and solution development, as opposed to photosensitive silver halide prepared with known procedures to provide a direct-positive image. The photosensitive silver halide is especially useful as the photosensitive component due to its high degree of photosensitivity.

A typical coverage of negative-working photosensitive silver halide is within the range of about 0.001 to about 4.3 grams of negative-working photosensitive silver halide/$m^2$ of support of the photographic material. Especially useful photographic silver halides are silver chloride, silver bromide, silver bromoiodide, silver chlorobromoiodide or mixtures thereof. For purposes of the invention, silver iodide is also considered to be a useful photosensitive silver halide. Fine-grain photosensitive silver halides are especially useful, although coarse- or fine-grain photosensitive silver halide can be employed if desired. The photosensitive silver halide can be prepared by any of the procedures known in the photographic art for preparing negative-working photosensitive silver halide, especially those procedures which involve the preparation of negative-working photographic silver halide gelatino emulsions. Useful procedures and forms of negative-working photographic silver halide for purposes of the invention are described, for example, in the *Product Licensing Index*, Volume 92, December 1971, Publication No. 9232 on page 107, published by Industrial Opportunities Ltd., Homewell, Havant Hampshire, P09 1EF, UK. This description is incorporated herein by reference. The photosensitive silver halide, as described, can be washed or unwashed, can be chemically sensitized using chemical sensitization procedures known in the photographic art, can be protected against production of fog and stabilized against the loss of sensitivity during keeping as described in the above *Product Licensing Index* publication.

In the described image-forming combination a variety of organic silver salt oxidizing agents containing a heterocyclic thione or 1,2,4-mercaptotriazole ligand is useful. Combinations of the described organic silver salt oxidizing agents can be useful if desired. A variety of heterocyclic thione ligands is useful in the described organic silver salt oxidizing agent. A useful heterocyclic thione is represented, for example, by the formula:

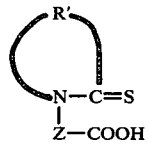

wherein R' represents the atoms completing a 5-member heterocyclic nucleus, preferably carbon, oxygen and nitrogen atoms, and Z is alkylene containing 1 to 10 carbon atoms. Examples of useful 5-member heterocyclic thione nuclei include thiazoline-2-thione, benzothiazoline-2-thione, imidazoline-2-thione, oxazoline-2-thione, and similar heterocyclic thione nuclei. The heterocyclic thione nucleus can contain substituent groups which do not adversely affect the sensitometric and other desired properties of the heat developable material of the invention, such as alkyl containing 1 to 3 carbon atoms, or phenyl.

Examples of useful heterocyclic thione ligands within the described formula include:

3-(2-carboxyethyl)-4-methyl-4-thiazoline-2-thione,
3-(2-carboxyethyl)benzothiazoline-2-thione,
3-(2-carboxyethyl)-5-phenyl-1,3,4-oxadiazoline-2-thione,
3-(2-carboxyethyl)-5-phenyl-1,3,4-thiadiazoline-2-thione,
3-carboxymethyl-4-methyl-4-thiazoline-2-thione,
3-(2-carboxyethyl)-1-phenyl-1,3,4-triazoline-2-thione,
1,3-bis(2-carboxyethyl)-imidazoline-2-thione, 1,3-bis(2-carboxyethyl)benzimidazoline-2-thione,
3-(2-carboxyethyl)-1-methylimidazoline-2-thione,
3-(2-carboxyethyl)benzoxazoline-2-thione, and
3-(1-carboxyethyl)-4-methyl-4-thiazoline-2-thione.

An especially useful organic silver salt oxidizing agent wherein the silver salt contains a heterocyclic thione ligand consists essentially of a silver salt of 3-carboxymethyl-4-methyl-4-thiazoline-2-thione.

A variety of organic silver salt oxidizing agents, as described, can be useful wherein the oxidizing agent contains a 1,2,4-mercaptotriazole ligand. Typically, such silver salt oxidizing agents consist essentially of a silver salt of a 1,2,4-mercaptotriazole represented by the formula:

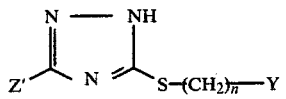

wherein Y is aryl containing 6 to 12 carbon atoms, such as phenyl, naphthyl, p-chlorophenyl and p-methoxyphenyl; N is 0 to 2; and Z' is amino ($-NH_2$), hydroxyl or hydrogen, amino being preferred.

Combinations of the described organic silver salts can be useful. The optimum combination of organic silver salts can be determined based on such factors as the desired image, other components in the heat developable material, processing conditions, and the like.

It has been found that those compounds in which Y is alkyl rather than aryl according to the described formula for the 1,2,4-mercaptotriazole ligand that significantly less than optimum results are obtained in certain heat developable materials according to the invention. Specifically, the developed image may have little image discrimination.

The described 1,2,4-mercaptotriazole ligand can be prepared by means of procedures known in the photographic art. For example, the preparation of 3-amino-5-benzylthio-1,2,4-triazole can be carried out by means of procedure described in the *Journal of the Chemical Society,* 3437 (1960) by L. Godfrey and F. Kurzer. The silver salt of the described 1,2,4-mercaptotriazole ligand can be prepared by mixing a source of silver ions, such as silver trifluoroacetate or silver nitrate with the described 1,2,4-triazole compound until reaction completion. The desired produce can be separated by filtration and washing or other known separation techniques. The preparation of the silver salt of 3-amino-5-benzylthio-1,2,4-triazole is illustrative of the preparation of silver salt oxidizing agents useful in photographic materials as described.

The organic silver salt oxidizing agent typically is prepared in the form of a dispersion which can be mixed with other components of the described photographic materials of the invention. The following is an example of the preparation of such a dispersion. 6.18 Grams (0.03 mole) of 3-amino-5-benzylthio-1,2,4-triazole and 4.0 grams of deionized, photographic gelatin are dissolved with heating at 50° C. into 30 ml of a mixture of ethanol and methanol (95:5 parts by volume ethanol:methanol) and 140 ml of distilled water. The resulting solution was placed in a suitable reaction vessel equipped with a rapid mixing means and then a solution of 3.4 grams (0.02 moles) of silver nitrate in 30 ml of distilled water was added rapidly at 50° C. while the solution was rapidly mixed. The reactants were mixed rapidly for 40 minutes followed by cooling to about 19° C. The resulting desired dispersion was diluted to 200 grams (10 kilograms per silver mole) with distilled water.

It can be useful in some cases to prepare the described silver salts of the 1,2,4-mercaptotriazole ligand in other compositions than in gelatin, as described, such as, for example, in poly(vinyl alcohol) or compositions containing no vehicle. Other compositions can be in the form of organic solvent or aqueous solutions or the like. The organic silver salt oxidizing agents can be separated in their pure form and stored prior to use. However, for photographic purposes according to the invention it is often useful to prepare the organic silver salt oxidizing agent in the form of a dispersion.

Preparation of the described heterocyclic thione compounds and silver salt of these compounds can be carried out by means of procedures known in the art. These procedures are described, for example, in U.S. Pat. No. 3,893,860 of Sutton et al, issued July 8, 1975.

An especially useful embodiment of the invention is a covering power, heat developable photographic element, as described, wherein the organic silver salt oxidizing agent consists essentially of a silver salt of 3-amino-5-benzylthio-1,2,4-triazole.

The term "salt" as used herein is intended to include any type of bonding or complexing mechanism which enables the resulting material to provide imaging properties in the described heat developable materials according to the invention. In some instances the exact bonding within the described silver salt oxidizing agent is not fully understood. Accordingly, the term "salt" is intended to include complexes which enable the desired image-forming combination to provide the desired image. The term "salt" is intended to include neutral complexes or non-neutral complexes.

A useful concentration of the described organic silver salt oxidizing agent in a covering power, heat developable photographic material for reversal imaging according to the invention is typically based upon the amount of silver in the silver salt oxidizing agent and is within the range of about 0.25 g to about 5.0 g $Ag/m^2$ in the heat developable photographic material. An especially useful concentration of silver salt oxidizing agent based upon the amount of silver in the silver salt oxidizing agent is within the range of about 1 g to about 2 g $Ag/m^2$ in the heat developable photographic material. The optimum concentration of the described organic silver salt oxidizing agent can be determined based upon such factors as the desired image, other components in the heat developable material, processing conditions and the like.

The described heat developable photographic materials can contain a variety of organic reducing agents in the image-forming combination. These organic reducing agents are typically organic, silver halide developing agents. Combinations of organic reducing agents can be useful. For example, a combination of a 3-pyrazolidone reducing agent with a hydroquinone reducing agent can be useful. A variety of silver halide developing agents is useful in the heat developable photographic material including, for example, polyhydroxybenzenes, such as hydroquinone, alkyl-substituted hydroquinones, including tertiary-butyl hydroquinone, isopropyl hydroquinone, methyl hydroquinone, 2,5-dimethyl hydroquinone, and 2,6-dimethyl hydroquinone; catechol and pyrogallol developing agents; chloro-substituted hydroquinones such as chlorohydroquinone or dichlorohydroquinine; alkoxy-substituted hydroquinones such as methoxy hydroquinone or ethoxy hydroquinone; aminophenol reducing agents such as 2,4-diaminophenols and methylaminophenols; ascorbic acid developing agents such as ascorbic acid, ascorbic acid ketals and ascorbic acid derivatives; 3-pyrazolidone developing agents such as 1-phenyl-3-pyrazolidone and 4-methyl-4-hydroxymethyl-1-phenyl-3-pyrazolidone; reductone silver halide developing agents, such as 2-hydroxy-5-methyl-3-piperidino-2-cyclopentanone; gallic acid ester reducing agents such as methylgallate; sulfonamidophenol developing agents such as the sulfonamidophenol developing agents described in *Research Disclosure,* January 1973, pages 16–21; and phenylenediamine developing agents such as paraphenylenediamine and the like.

The term "silver halide developing agent" as employed herein is intended to include compounds which are developing agent precursors in the described heat developable photographic materials. That is, those materials are intended which are not developing agents in the heat developable photographic material until a condition occurs, such as heating of the heat developable photographic material.

A useful concentration of the described organic reducing agent, typically the silver halide developing agent, in a heat developable photographic material as described is typically within the range of about 1.80 g to about 8.6 grams of the organic reducing agent per square meter of support of the heat developable photographic material. An especially useful concentration of organic reducing agent is within the range of about 4.30 g to about 6.45 g of the reducing agent per square meter of support. An optimum concentration of organic reducing agent can be determined based upon such factors as the desired image, other components of the heat developable photographic material, processing conditions and the like. When a combination of reducing agents is found useful, the concentration of the total combination of reducing agents is within the scope of the described concentration ranges.

A variety of hydrazino thiourea nucleating agents is useful in a photographic material as described. Combinations of hydrazino thiourea nucleating agents can also be useful if desired. Examples of useful hydrazino thiourea nucleating agents include those described in U.S. Pat. No. 4,030,925 of Leone et al, issued June 21, 1977. Especially useful hydrazino thiourea nucleating agents are represented by the formula:

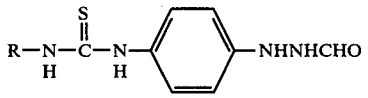

wherein R is alkyl containing 1 to 10 carbon atoms or aryl containing 6 to 12 carbon atoms. Examples of useful alkyl groups include methyl, ethyl, propyl, butyl, pentyl and decyl. Examples of useful aryl groups include phenyl and naphthyl.

A nucleating concentration of the described hydrazino thiourea nucleating agent is necessary in the covering power, heat developable photographic material to provide a desired positive image. The exact mechanism by which the described nucleating agent provides the desired image is not fully understood; however, it is believed that the nucleating agent provides fogging of the described organic silver salt in non-exposed areas upon heating the element to processing temperature. Therefore, it is necessary to provide a sufficient concentration of the nucleating agent to produce the desired degree of fogging. A typically useful range in a heat developable element is within the range of about $10^{-4}$ to about $10^{-1}$ grams of the described nucleating agent per square meter of support of the heat developable element, such as within the range of about $5\times10^{-4}$ to $2\times10^{-1}$ grams of nucleating agent per square meter of support of the heat developable element. The optimum concentration of hydrazino thiourea nucleating agent will depend upon such factors as the concentration of other components in the heat developable material, desired image, processing conditions and the like.

An especially useful embodiment of the invention is one wherein the hydrazino thiourea nucleating agent consists essentially of 1-[4-(2-formylhydrazino)phenyl]-3-phenylthiourea. Another useful embodiment is one wherein the hydrazino thiourea nucleating agent consists essentially of 1-[4-(2-formylhydrazino)phenyl]-3-methylthiourea.

The described heat developable material can contain a variety of colloids and polymers alone or in combination as vehicles, binding agents and in various layers. Useful materials, as described, can be hydrophilic materials, although some hydrophobic materials can also be useful. The colloids and polymers are transparent or translucent and include such naturally-occurring substances as proteins, for example, gelatin, gelatin derivatives, cellulose derivatives, polysaccharides, such as dextran and the like; and synthetic polymeric materials such as hydrophilic polyvinyl compounds like poly(vinyl pyrrolidone), acrylamide polymers and the like. Other synthetic polymeric materials that can be useful include dispersed vinyl compounds such as in latex form and particularly those which increase dimensional stability of photographic materials. Effective polymers include those high molecular weight materials, polymers and resins which are compatible with the described organic silver salt oxidizing agents and other components of the developable photographic materials according to the invention. Especially useful materials include gelatin, poly(vinyl pyrrolidone), and poly(vinyl alcohol). Other useful polymeric materials include copolymers of acrylamide with 1-vinylimidazole or 2-acetoacetoxyethylmethacrylate. Combinatiions of the described colloids and polymers can also be useful.

It is often useful to use one or more of the described polymers or colloids as an overcoat layer or layers on the described heat developable material to provide increased resistance to abrasion marks and other advantages.

One useful embodiment of the inventiion is a covering power, heat developable photographic element comprising a support having thereon, in a gelatino binder and in reactive association: (a) a negative-working photosensitive silver halide gelatino emulsion, (b) an image-forming combination comprising (i) an organic silver salt oxidizing agent consisting essentially of the silver salt of 3-carboxymethyl-4-methyl-4-thiazoline-2-thione with (ii) an organic reducing agent consisting essentially of tertiary butyl hydroquinone, and (c) a nucleating concentration of a hydrazino thiourea nucleating agent consisting essentially of 1-[4-(2-formylhydrazino)-phenyl]-3-phenylthiourea.

The described components of the heat developable materials according to the invention can be in any suitable location in the heat developable materials which provides the desired positive developed image. For example, if desired, one or more of the components of the heat developable photographic element described can be in one or more layers of the element. In some cases it can be desirable to include certain percentages of the described silver halide developing agent, the silver salt oxidizing agent and other addenda in a protective layer over the photographic layer of an element as described. It is necessary that the layers be contiguous to provide the desired imaging upon processing. In this sense the components must be in a location which enables their desired interaction upon processing.

It is necessary that the negative-working photosensitive silver halide, as described, and other components in the image-forming combination be in reactive association with each other in order to provide the desired image. The term "in reactive association", as employed herein, is intended to mean that the photosensitive silver halide and the image-forming combination with the described nucleating agent are in a location with respect to each other which enables the desired processing and provides a useful covering power reversal image. It is believed that the latent image formed upon imagewise exposure of the photosensitive silver halide acts as a catalyst for the image-forming combination as described. While the exact nature of the reaction mechanisms and image formation in the heat developable photographic material described is not fully understood, it is believed that the reaction is an amplification reaction enabled by the catalytic effect of the latent image silver.

The described heat developable photographic elements can comprise a variety of supports which can tolerate the processing temperatures useful according to the invention. Typical supports include cellulose ester film, poly(vinyl acetal) film, poly(ethylene terephthalate) film, polycarbonate film and polyester film supports. Related film and resinous support materials as well as glass, paper, metal and the like supports which can withstand the processing temperatures described are also useful. Typical, a flexible support is most useful.

The heat developable materials according to the invention can contain other addenda, such as compounds which function as speed-increasing compounds, hardeners, plasticizers and lubricants, coating aids, brighteners, absorbing and filter dyes, antistatic materials or layers, and the like. These are described, for example, in the *Product Licensing Index,* Volume 92, December 1971, Publication 9232, pages 107–110.

It can be advantageous in some instances to include a base-release agent, also known as a base precursor, in the heat developable photographic materials according to the invention to provide improved or more effective image development. A base-release agent, as described herein, is intended to include compounds which upon heating in the heat developable photographic material provide a more effective reaction between the described photosensitive silver halide and the image-forming combination. Examples of useful base-release agents are guanidinium compounds, such as guanidinium trichloroacetate, aminimide base-release agents and other compounds which are known to release a base moiety upon heating but do not adversely affect photosensitive silver halide materials.

If desired, a toning agent can be useful in the heat developable photographic material to provide a desired image. Useful toning agents include, for example, certain heterocyclic compounds which can provide a more neutral tone image. Examples of useful toning agents in a heat developable material, as described, containing a heterocyclic thione silver salt oxidizing agent include 3-mercapto-1,2,4-triazole and 2,4-dimercaptopyrimidine.

Spectral sensitizing dyes can be useful in the described photographic materials to confer additional sensitivity to the materials. Useful sensitizing dyes can be selected from those described, for example, in the *Product Licensing Index,* Volume 92, December 1971, Publication No. 9232, pages 107–110, paragraph XV. Selection of an optimum spectral sensitizing dye or dye combination will depend upon such factors as the particular silver halide used, the desired spectral sensitivity, and the like.

The various components of the heat developable photographic materials, as described, can be added from water solutions, or suitable organic solvents can be useful to aid in addition. The components can be mixed using various procedures known in the photographic art.

The heat developable materials according to the invention can be coated on a suitable support by various coating procedures known in the photographic art including dip coating, airknife coating, curtain coating or extrusion coating using hoppers. If desired, two or more layers can be coated simultaneously as known in the photographic art.

A variety of imagewise exposure means can be useful with the heat developable photographic materials as described. The materials are typically sensitive to the ultraviolet and blue regions of the spectrum and exposure means which provide this radiation are preferred. Typically however, if a spectral sensitizing dye is employed in the heat developable photographic material, exposure means using other ranges of the electromagnetic spectrum are applicable. Typically, a heat developable photographic element according to the invention is exposed imagewise with a visible light source, such as a tungsten lamp, although other sources of radiation are useful, such as lasers, electron beams, X-ray sources and the like. The heat developable photographic material is typically exposed imagewise to provide a developable latent image.

A visible direct-positive image can be developed in an exposed, heat developable photographic material, as described, within a short time, such as within several seconds, merely by uniformly heating the photographic material to moderately elevated temperatures. For example, the imagewise exposed photographic material can be heated to a temperature within the range of about 120° C. to about 200° C., typically about 120° C. to about 170° C. Heating is carried out until a desired image is developed, typically within about 1 to about 60 seconds, such as within 1 to 30 seconds. At the lower processing temperatures, such as at about 125° C., development of an image requires a long processing time.

Accordingly, another embodiment of the invention is a process of developing a reversal image in a covering power, heat developable photographic element, as described, which has been imagewise exposed, comprising heating the described element to a temperature within the range of about 120° C. to about 200° C. until the image is developed.

Processing according to the invention is usually carried out under ambient conditions of pressure and humidity. Pressures and humdity outside normal atmospheric conditions can be employed if desired; however, normal atmospheric conditions are preferred.

A variety of means can be useful to provide the necessary heating of the described heat developable photographic material to provide a developed image. The heating means can be a simple hot plate, iron, roller, heated drum or the like.

The following examples are included for a further understanding of the invention.

EXAMPLE 1

This example illustrates the invention.

A silver complex of 3-carboxymethyl-4-methyl-4-thiazoline-2-thione was prepared as described in Example 22 of U.S. Pat. No. 3,785,830. The molar ratio of the thione ligand to silver ion was 1.5:1.

A heat developable photographic composition was prepared by combining the following components in the order indicated:

| | |
|---|---|
| gelatino silver bromoiodide emulsion (30 mole percent iodide, 1.99 kilograms of emulsion per mole of silver, 25 grams of gelatin per mole of silver, 0.14 micron AgBrI) | 0.25 ml |
| silver complex dispersion, as described in Example 22 of U.S. 3,785,830, (organic silver salt oxidizing agent) | 14 ml |
| dimethylformamide-acetone solution (1:9 parts by volume) containing 0.4 percent by weight of 1-[4-(2-formylhydrazino)phenyl]-3-phenylthiourea (nucleating agent) | 1 ml |
| methanol solution containing 30% by weight tertiary-butyl hydroquinone (organic reducing agent) | 2.6 ml |

The resulting composition was mixed thoroughly and then coated on a clear poly(ethylene terephthalate) film support at a 0.004 inch wet coating thickness. The resulting heat developable photographic element was permitted to dry and then was imagewise exposed for one second to tungsten light through a graduated density (0.30 log E) step wedge to provide a developable latent image in the photographic element. The exposed element was then heated for 4 seconds at 160° C. A reversal image was developed. The developed image had a maximum density of 1.36 (this was a blue density in which the maximum developed density was obtained by reading the developed densities with a combination of known filters, i.e., three Wratten 47-B filters plus one X-1274 filter plus one C-9782 filter, Wratten is a trademark). The minimum density of the image was 0.42. The element was assigned a relative speed of 100.

EXAMPLE 2

This is a comparative example.

The procedure described in Example 1 was repeated with the exception that the heat developable photographic composition prior to coating did not contain the described nucleating agent. The element was imagewise exposed and heat processed as described in Example 1. The resulting element had a maximum density of 0.40 and a minimum density of 0.32.

EXAMPLE 3

This is a comparative example.

The procedure described in Example 1 was repeated with the exception that the heat developable composition prior to coating did not contain the photosensitive silver halide. The element was imagewise exposed and heat processed as described in Example 1. The resulting element had a uniform black developed density of 1.42 (no image).

EXAMPLE 4

This is a comparative example.

The procedure described in Example 1 was repeated with the exception that the photographic composition prior to coating did not contain the photosensitive silver halide and did not contain the described nucleating agent. The element was imagewise exposed and heat processed as described in Example 1. The resulting element had a maximum density of 0.33 and a minimum density of 0.33 (no image).

The results of Examples 1–4 indicate that a covering power reversal image can be obtained by the heat developable photographic material as described in Example 1.

EXAMPLE 5

This illustrates the invention.

A photographic composition was prepared by mixing the following components and coating them on a poly(ethylene terephthalate) film support:

| | |
|---|---|
| silver bromoiodide gelatino emulsion (0.5 microns AgBrI, 30 mole percent iodide) | 0.22 g/meter$^2$ |
| 1-[4-(2-formylhydrazino)-phenyl]-3-phenylthiourea (nucleating agent) | 0.01 g/meter$^2$ |
| 4-carboxymethyl-4-thiazoline-2-thione | 0.11 g/meter$^2$ |
| methyl hydroquinone (reducing agent) | 4.20 g/meter$^2$ |
| surfactant (Surfactant 10G, polyglycidol ether surfactant available from and trade name of Olin Corporation, U.S.A.) | 0.11 g/meter$^2$ |
| bone gelatin (binder) | 1.99 g/meter$^2$ |
| silver salt of 3-amino-5-benzylthio-1H-1,2,4-triazole (3.07 grams of the triazole ligand per meter$^2$) | 1.08 g of silver per meter$^2$ |

The resulting coating was permitted to dry to provide a heat developable photographic element. The element was imagwise exposed to tungsten light for $10^{-3}$ seconds through a graduated density step wedge (+1.0 neutral density) to provide a developable latent image. After imagewise exposure, the resulting image was developed by uniformly heating the element at 130° C. for 30 seconds. The image discrimination (ΔD) of the resulting developed image was 1.46. ΔD is equal to maximum density (Dmax) minus minimum density (Dmin).

The invention has been described in detail with particular reference to preferred embodiments thereof, but it will be understood that variations and modifications can be effected within the spirit and scope of the invention.

What is claimed is:

1. A covering power, heat developable photographic element comprising a support having thereon, in binder and in reactive association:

(a) negative-working photosensitive silver halide, (b) an image-forming combination comprising (i) an organic silver salt oxidizing agent containing a heterocyclic thione ligand or 1,2,4-mercaptotriazole ligand with (ii) an organic reducing agent, and (c) a nucleating concentration of a hydrazino thiourea nucleating agent, said element being capable of providing a positive image when exposed and heat developed.

2. A photographic element as in claim 1 wherein said hydrazino thiourea nucleating agent (c) is represented by the formula:

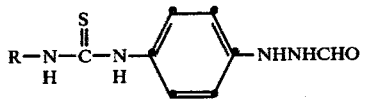

wherein R is alkyl containing 1 to 10 carbon atoms or aryl containing 6 to 12 carbon atoms.

3. A photographic element as in claim 1 wherein said hydrazino thiourea nucleating agent consists essentially of 1-[4-(2-formylhydrazino)phenyl]-3-phenylthiourea.

4. A photographic element as in claim 1 wherein said hydrazino thiourea nucleating agent consists essentially of 1-[4-(2-formylhydrazino)phenyl]-3-methylthiourea.

5. A photographic element as in claim 1 wherein said nucleating concentration of said nucleating agent is within the range of about $5\times10^{-4}$ grams to about $2\times10^{-1}$ grams of said nucleating agent per square meter of support.

6. A photographic element as in claim 1 wherein said negative photosensitive silver halide consists essentially of a negative photosensitive silver halide gelatino emulsion.

7. A photographic element as in claim 1 wherein said organic silver salt oxidizing agent is a silver salt of a heterocyclic thione represented by the formula:

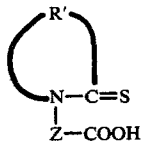

wherein R′ represents the atoms selected from carbon, nitrogen, sulfur and oxygen atoms necessary to complete a five-member heterocyclic nucleus and Z is alkylene containing 1 to 10 carbon atoms.

8. A photographic element as in claim 1 wherein said organic silver salt oxidizing agent consists essentially of a silver salt of 3-carboxymethyl-4-methyl-4-thiazoline-2-thione.

9. A photographic element as in claim 1 wherein said organic silver salt oxidizing agent consists essentially of a silver salt of a 1,2,4-mercaptotriazole derivative represented by the formula:

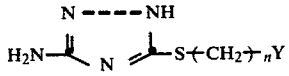

wherein Y is aryl containing 6 to 12 carbon atoms; and n is 0 to 2.

10. A photographic element as in claim 1 wherein said organic silver salt oxidizing agent consists essentially of a silver salt of 3-amino-5-benzylthio-1,2,4-triazole.

11. A photographic element as in claim 1 wherein said organic reducing agent consists essentially of a polyhydroxybenzene silver halide developing agent.

12. A covering power, heat developable photographic element comprising a support having thereon, in a gelatino binder and in reactive association:

(a) negative-working photosensitive silver halide gelatino emulsion, (b) an image-forming combination comprising (i) an organic silver salt oxidizing agent consisting essentially of the silver salt of 3-carboxymethyl-4-methyl-4-thiazoline-2-thione, with (ii) an organic reducing agent consisting essentially of tertiary-butylhydroquinone, and (c) a nucleating concentration of a hydrazino thiourea nucleating agent consisting essentially of 1-[4-(2-formylhydrazino)phenyl]-3-phenylthiourea, said element being capable of providing a positive image when exposed and heat developed.

13. A covering power, heat developable photographic composition comprising, in binder and in reactive association:

(a) negative-working photosensitive silver halide, (b) an image-forming combination comprising (i) an organic silver salt oxidizing agent that contains a heterocyclic thione ligand or 1,2,4-mercaptotriazole ligand with (ii) an organic reducing agent, and (c) a nucleating concentration of a hydrazino thiourea nucleating agent, said composition being capable of providing a positive image when exposed and heat developed.

14. A photographic composition as in claim 13 wherein said hydrazino thiourea nucleating agent is represented by the formula:

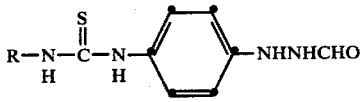

wherein R is alkyl containing 1 to 10 carbon atoms or aryl containing 6 to 12 carbon atoms.

15. A photographic composition as in claim 13 wherein said hydrazino thiourea nucleating agent consists essentially of 1-[4-(2-formylhydrazino)phenyl]-3-phenylthiourea.

16. A photographic composition as in claim 13 wherein said hydrazino thiourea nucleating agent consists essentially of 1-[4-(2-formylhydrazino)phenyl]-3-methylthiourea.

17. A photographic composition as in claim 13 wherein said negative-working photosensitive silver halide consists essentially of a negative-working photosensitive silver halide gelatino emulsion.

18. A photographic composition as in claim 13 wherein said organic silver salt oxidizing agent is a silver salt of a heterocyclic thione represented by the formula:

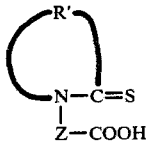

wherein R′ represents the atoms selected from carbon, nitrogen, sulfur and oxygen atoms completing a five-member heterocyclic nucleus and Z is alkylene containing 1 to 10 carbon atoms.

19. A photographic composition as in claim 13 wherein said organic silver salt oxidizing agent consists essentially of a silver salt of 3-carboxymethyl-4-methyl-4-thiazoline-2-thione.

20. A photographic composition as in claim 13 wherein said organic silver salt oxidizing agent consists essentially of a silver salt of a 1,2,4-mercaptotriazole represented by the formula:

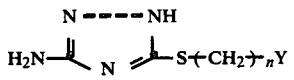

wherein Y is aryl containing 6 to 12 carbon atoms; and n is 0 to 2.

21. A photographic composition as in claim 13 wherein said organic silver salt oxidizing agent consists essentially of a silver salt of 3-amino-5-benzylthio-1,2,4-triazole.

22. A photographic composition as in claim 13 wherein said organic reducing agent consists essentially of a polyhydroxybenzene silver halide developing agent.

23. A covering power, heat developable photographic composition comprising, in a gelatino binder and in reactive association:

(a) negative-working photosensitive silver halide gelatino emulsion, (b) an image-forming combination comprising (i) an organic silver salt oxidizing agent consisting essentially of the silver salt of 3-carboxymethyl-4-methyl-4-thiazoline-2-thione, with (ii) an organic reducing agent consisting essentially of tertiary-butylhydroquinone, and (c) a nucleating concentration of a hydrazino thiourea nucleating agent consisting essentially of 1-[4-(2-formylhydrazino)phenyl]-3-phenylthiourea, said composition being capable of providing a positive image when exposed and heat developed.

24. A process of developing a positive image in a covering power, heat developable photographic element as defined in claim 1, which has been imagewise exposed, comprising heating said element to a temperature within the range of about 120° C. to about 200° C. until said image is developed.

25. A process of developing a positive image in a covering power, heat developable photographic element as defined in claim 12, which has been imagewise exposed, comprising heating said element to a temperature within the range of about 120° C. to about 200° C. until said image is developed.

26. A covering power, heat developable photographic element comprising a support having thereon, in binder and in reactive association:

(a) negative-working photosensitive silver halide, (b) an image-forming combination comprising (i) an organic silver salt oxidizing agent consisting essentially of a silver salt of a heterocyclic thione represented by the formula:

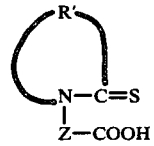

wherein R′ represents the atoms selected from carbon, nitrogen, sulfur and oxygen atoms necessary to complete a five-member heterocyclic nucleus and Z is alkylene containing 1 to 10 carbon atoms; or a silver salt of a 1,2,4-mercaptotriazole derivative represented by the formula:

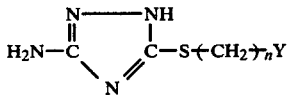

wherein Y is aryl containing 6 to 12 carbon atoms; and n is 0 to 2; with (ii) an organic reducing agent consisting essentially of a polyhydroxybenzene silver halide developing agent, and (c) a nucleating concentration of a hydrazino thiourea nucleating agent represented by the formula:

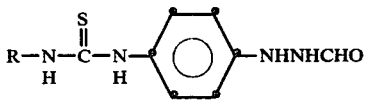

wherein R is alkyl containing 1 to 10 carbon atoms or aryl containing 6 to 12 carbon atoms.

* * * * *